US009151296B2

(12) United States Patent
Gårdhagen et al.

(10) Patent No.: US 9,151,296 B2
(45) Date of Patent: Oct. 6, 2015

(54) DEVICE FOR PUMPING A FLUID AT LOW FLOWS

(71) Applicant: Envic-Sense AB, Västerås (SE)

(72) Inventors: Peter Gårdhagen, Västerås (SE); Eva-Lena Gårdhagen, Västerås (SE)

(73) Assignee: Envic-Sense AB, Västerås (SE)

( * ) Notice: Subject to any disclaimer, the term of this patent is extended or adjusted under 35 U.S.C. 154(b) by 0 days.

(21) Appl. No.: 14/386,635

(22) PCT Filed: Mar. 19, 2013

(86) PCT No.: PCT/EP2013/055700

§ 371 (c)(1),
(2) Date: Sep. 19, 2014

(87) PCT Pub. No.: WO2013/139794

PCT Pub. Date: Sep. 26, 2013

(65) Prior Publication Data

US 2015/0050124 A1 Feb. 19, 2015

(30) Foreign Application Priority Data

Mar. 22, 2012 (SE) ..... 1230029

(51) Int. Cl.

| | |
|---|---|
| ***F04D 29/18*** | (2006.01) |
| ***F04D 25/02*** | (2006.01) |
| ***F04D 5/00*** | (2006.01) |
| ***F04B 19/18*** | (2006.01) |
| ***F04B 19/20*** | (2006.01) |
| *B01L 3/00* | (2006.01) |

(52) U.S. Cl.

CPC ..... *F04D 29/181* (2013.01); *F04B 19/18* (2013.01); *F04B 19/20* (2013.01); *F04D 5/001* (2013.01); *F04D 25/02* (2013.01); *B01L 3/50273* (2013.01); *F05B 2250/80* (2013.01)

(58) Field of Classification Search

CPC ..... F04D 5/001; F04D 25/02; F04D 29/181; F04B 19/18; F04B 19/20; F05B 2250/80

See application file for complete search history.

(56) References Cited

U.S. PATENT DOCUMENTS

| | | | | |
|---|---|---|---|---|
| 7,371,052 | B2 * | 5/2008 | Koeneman | 417/53 |
| 7,604,393 | B2 * | 10/2009 | Koeneman | 366/273 |
| 2006/0057004 | A1 | 3/2006 | Koeneman | |
| 2007/0059156 | A1 * | 3/2007 | Blanchard et al. | 415/90 |

FOREIGN PATENT DOCUMENTS

| | | | |
|---|---|---|---|
| JP | 2008-196481 | A | 8/2008 |
| WO | 2005/121744 | A1 | 12/2005 |

* cited by examiner

*Primary Examiner* — Igor Kershteyn
(74) *Attorney, Agent, or Firm* — Dilworth & Barrese, LLP.

(57) ABSTRACT

The present invention relates to a device for pumping a fluid at low flows, comprising a body (1) including a channel (2) having a circular cross section for transportation of a fluid, and a cylindrical cavity (3) arranged in connection with the channel and with its longitudinal axis being non coplanar with the longitudinal axis of the channel, and a pump including a rotatable cylinder (6) extending into the cavity, coaxial with the cavity, with the periphery of the cylinder protruding into the channel, thereby driving the fluid in the channel by shear forces. The channel and the cylinder are both arranged at a distance from the bottom of the cavity, so as to form a cylindrical space (20) between the cylinder and the bottom of the cavity for receiving some of the driven fluid, wherein the cylinder and the cavity are arranged so that a vortex (23) is generated in the fluid in the space by the rotation of the cylinder, and an opening (22) is formed between the space and the channel, which allows the vortex generated in the space to continue into the channel. The device provides a steady and smooth flow in the channel.

8 Claims, 2 Drawing Sheets

DEVICE FOR PUMPING A FLUID AT LOW FLOWS

FIELD OF THE INVENTION

The present invention relates to a device for pumping a fluid at low flows. Such a device can be used in various types of systems for pumping fluid at flows less than 100 ml/s.

PRIOR ART

There are many applications where small amounts of fluid has to be transported, for example, in connection with various types of measurement in a fluid, such as detecting and measuring small quantities of a certain substance, when counting cells, and measurement of the kinetics of chemical reactions. Thus, there is a need to develop small, simple, and inexpensive pumps for pumping small amounts of a fluid, in the order of less than 100 ml/s. To obtain a good reliability, it is important that the pump has as few moving parts as possible.

US2006/0057004 shows an example of a pump that is embedded in a substrate and has a homopolar motor including a rotatable disc provided with fluid blades. The rotatable disc is placed in a cavity in the substrate and is connected to a flow channel defined in the substrate. A disadvantage of this pump is that it is relatively expensive. In some applications the pump is used only once, and discarded after use. An example of such application is measurement cells that cannot be reused, and are discarded after measuring.

WO2005/121744 shows an example of a disposable device containing a pump for transporting fluid in a measuring cell for detecting and measuring small quantities of a certain substance. The measuring cell has a body containing a sensor and flow channels for transporting a fluid containing a substance to be measured past the sensor. A friction pump comprising a rotatable cylinder is arranged in connection with one of the channels, such that a portion of the envelope surface of the cylinder is positioned in the channel. The cylinder is arranged so that its longitudinal axis is perpendicular to the longitudinal axis. When the cylinder is rotated about its longitudinal axis, the friction between the cylinder and the fluid and the internal friction of the fluid creates a flow radially out from the cylinder. In this manner, the pump achieves a flow in the channel. Such a pump is simple and inexpensive to manufacture.

The pump serves to continuously pump the fluid past the sensor so that no pressure differences arise. It is important that the flow is evenly and smoothly to avoid the risk that particles being transported in the fluid will sink to the bottom of the channel and stay there, instead of passing the sensor, and to ensure that a sample of the fluid retains its volume when it passes the sensor. In order to provide an even flow, stationary flow vortices should be avoided.

A disadvantage of the pump shown in WO2005/121744 is that the flow decreases with the distance from the cylinder, resulting in an uneven flow profile, with high flow speed in the part of the channel nearest to the cylinder and a decreasing flow speed in the direction towards the opposite channel wall. FIG. 9 shows how the flow profile may look in a channel with this type of pump. This flow profile provides a risk for sedimentation of particles in the part of the channel where the flow speed is low and can also lead to extension of the sample in the flow direction, which results in an undesirable dilution of the sample. The location of the pump in the flow channel also constitutes a risk for formation of stationary flow vortices, so-called Couette flow. These flow vortices provide a risk that the particles to be measured accumulate and will not pass the sensor, which in turn means that the measurement is impaired.

OBJECT AND SUMMARY OF THE INVENTION

The object of the present invention is to provide an inexpensive and simple device for pumping a fluid at low flows, which achieves a smooth and undisturbed flow.

This object is achieved with a device as defined herein.

The device comprises a body including a channel having a circular cross section for transportation of a fluid and a cylindrical cavity arranged in connection with the channel and with its longitudinal axis angled relative to the longitudinal axis of the channel, and a pump including a rotatable cylinder extending into the cavity and arranged so that a part of the cylinder is located in the channel. The invention is characterized in that the channel and the cylinder are arranged at a distance from the bottom of the cavity, so as to form a cylindrical space between the cylinder and the bottom of the cavity for receiving a fluid, wherein the cylinder and the cavity are arranged so that a vortex is generated in the fluid in the space by the rotation of the cylinder, and the cylinder is extending partially into the channel so that an opening is formed between the space and the channel, which allows the vortex generated in the space to continue into the channel.

When the cylinder rotates about its center axis, a vortex is generated in the space below the cylinder due to the friction between an end face of the cylinder and the fluid in the space. Due to the fact that the cylinder extends only partially into the channel, the generated vortex is allowed to continue into the channel through the opening between the space and the channel. The vortex causes an increase of the flow speed in a central part of the channel, thereby achieving a more uniform flow profile across the flow direction in the channel. The vortex continues along the channel walls, which ensures that any sedimented material is moved closer to the central part of the channel, and that there becomes a stirring of the fluid in the channel. The flow from the vortex, which is generated in the space below the cylinder, counteracts the formation of stationary flow vortices in the channel. The device thus gives an even and smooth flow in the channel, which makes it possible for samples added to the fluid to retain its volume and not be diluted.

The device comprises only one moving part in the form of a cylinder, and is therefore simple and inexpensive to manufacture. Due to its simple design, it is easy to change the size of the device and design it for flows of different volumes. It is possible to scale down the device to make is capable of pumping flows in the order of μl/s.

According to an embodiment of the invention, the cylinder and the cavity are arranged so that the ratio between diameter of the cylinder and the distance between the cylinder and the bottom of the cavity is between 1 and 2, preferably between 1.2 and 1.6. This condition ensures that a sufficiently strong vortex can be generated to obtain a sufficiently smooth and undisturbed flow profile in the channel and to avoid stationary flow vortices in the channel.

According to an embodiment of the invention, the cylinder is arranged such that the distance between the cylinder and the bottom of the channel at the opening is between 0.5 and 1 mm. This distance has been proven to be beneficial to bring the vortex to continue into the channel through the opening between the space and the channel.

According to an embodiment of the invention, the device is provided with a drive unit for automatically rotating the cylinder at least one revolution per second, preferably at least 2 revolutions per second. In order to generate a sufficiently strong vortex, the cylinder should rotate at least one revolution per second, and preferably at least two revolutions per second. The drive unit may comprise a motor with a transmission to the cylinder.

According to an embodiment of the invention, the surface of the cylinder is substantially smooth, i.e. the surface is not provided with any projections for increasing the friction against the fluid or for pressing or pushing away the water and thereby increase the flow speed. A smooth surface provides sufficient friction against the fluid to generate the desired vortex. It is simple and inexpensive to manufacture a cylinder with a smooth surface.

According to an embodiment of the invention, the pump comprises a drive wheel and a drive shaft fixedly mounted between the drive wheel and the cylinder, wherein the drive wheel has a substantially larger diameter than the cylinder. Such a pump is simple and inexpensive to manufacture.

A device according to the invention can advantageously be used to circulate fluid past a sensor in a measuring cell for the detection and quantification of heavy metals, such as mercury.

BRIEF DESCRIPTION OF THE DRAWINGS

The invention will now be explained more closely by the description of various embodiments of the invention and with reference to the appended figures.

DETAILED DESCRIPTION OF PREFERRED EMBODIMENTS OF THE INVENTION

Figure 1:
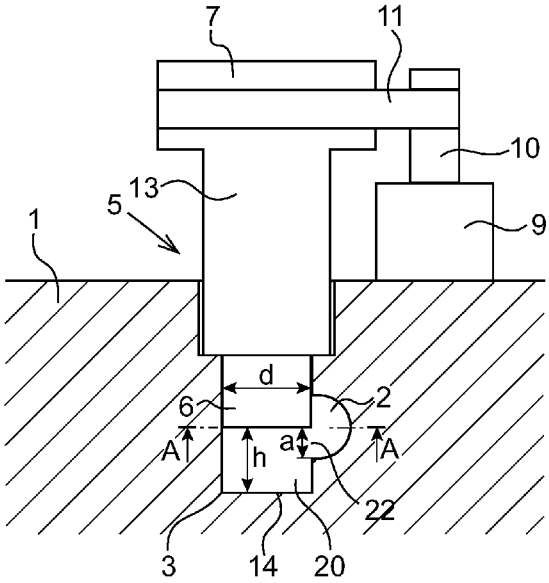
FIG. 1 shows a device for pumping fluid in a channel according to an embodiment of the invention.
Figure 2:
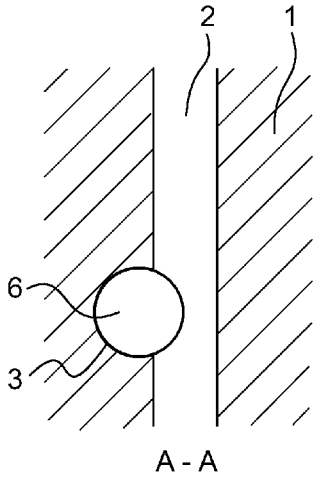
FIG. 2 shows a cross section along a line A-A of the device shown in FIG. 1.

FIG. 1 shows a device for pumping fluid at low flows according to an embodiment of the invention. The device comprises a body 1 with an elongated channel 2 for the transport of fluid and a cylindrical cavity 3 disposed adjacent to the channel 2. The channel 2 is cylindrical and has a circular cross section. The cavity 3 is arranged so that the longitudinal axis of the cavity is angled relative to the longitudinal axis of the channel. The angle between the longitudinal axis of the cavity and the longitudinal axis of the channel should preferably be more than 45°. More preferably, the cavity is arranged with its longitudinal axis substantially perpendicular to the longitudinal axis of the channel.

The body 1 is preferably made of a plastic material, such as polyetheretherketone (PEEK) or acrylic plastic, but can also be made of glass. The body 1 may, for example, be part of a disposable measurement cell for detecting and/or measuring particles. The device can advantageously be used to control the fluid flow to a sensor in the measuring cell, for example the measurement cell described in WO2005/121744.

The device comprises a pump which includes a rotatable pump body 5, which at one end is provided with an impeller in the form of a cylinder 6 that extends into the cavity 3, and at the other end is provided with a pinion 7. The cylinder 6 is arranged rotatable about its longitudinal axis. In this embodiment, the pump includes a drive unit 9 arranged to drive a rotation of the pump body 5, and thereby rotate the cylinder 6 in the cavity 3. The drive unit 9 includes a motor with a drive shaft 10, and a transmission belt 11 to transmit the motion of the drive shaft to the pump body 5. The drive unit should be designed so that the cylinder is rotated at least one revolution per second, and preferably at least 2 revolutions per second to generate a sufficiently large vortex. Alternatively, the pump can be equipped with means to manually drive the rotation of the cylinder, such as a crank.

Figure 3:
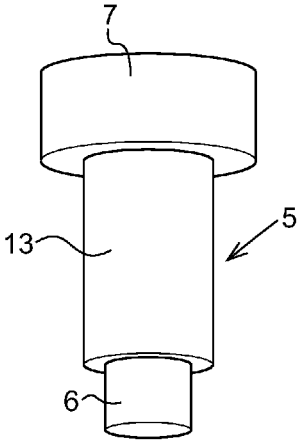
FIG. 3 shows a perspective view of a pump body of the device shown in FIG. 1.
Figure 4:
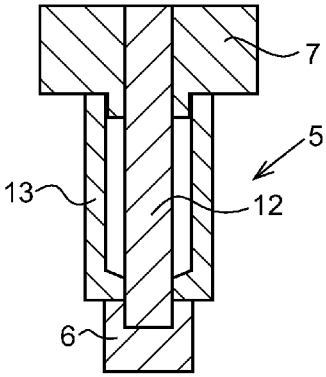
FIG. 4 shows a cross section through the pump body of FIG. 3.

FIG. 3 shows a perspective view of the pump body 5, and FIG. 4 shows a cross section through the pump body. The drive wheel 7 has a diameter that is larger than the diameter of the cylinder 6. The pump body 5 includes a drive shaft 12 fixedly disposed between the drive wheel 7 and the cylinder 6 so that the drive wheel and the cylinder moves as one body. A sleeve-shaped bushing 13 extends between the drive wheel 7 and the cylinder 6 and surrounds the drive shaft 12. The bushing 13 allows rotation of the pump body 5 relative to the body 1. The cylinder 6 has a smooth surface and is preferably made of organic polymeric thermoplastic material such as polyetheretherketone (PEEK), which is stable against acids and other corrosive substances. In the illustrated embodiment, the length of the pump body is about 25 mm, and the cylinder has a diameter of about 5 mm. The device is suitable for pumping flows in the order of 1-100 ml/s. By scaling down the size of the pump body and the cavity, it is possible to use the device for pumping even smaller flows, such as flows in the order of μl/s.

Figure 5:
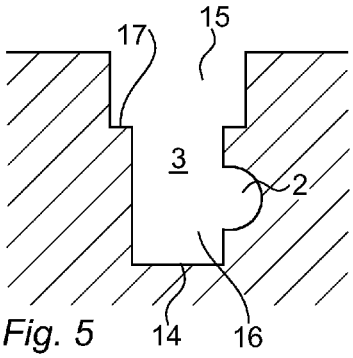
FIG. 5 shows a body with a cavity for receiving the pump body and a channel.

FIG. 5 shows the cavity 3 and the channel 2 before the pump body 5 is mounted. One end of the cavity has an opening for receiving the pump body and the other end of the cavity has a bottom 14. The cavity has an upper portion 15 adapted to receive the bushing 13 and a lower portion 16 adapted to receive the cylinder 6. The upper portion 15 has a larger diameter than the lower portion 16 so that a shoulder 17 is formed between the parts. FIG. 1 shows the device with the pump body 5 mounted and the cylinder 2 in place in the lower portion 16 of the cavity 3. The bushing 13 rests on the shoulder 17. The cylinder 6 is shorter than the lower portion 16 of the cavity, which means that the cylinder ends at a distance from the bottom of the cavity and a cylinder-shaped space 20 is formed between the cylinder 6 and the bottom 14 of the cavity.

The space 20 is in communication with the channel 2 and is filled with fluid during use of the device. The cylinder and the cavity are arranged so that a vortex is generated in the fluid in the space 20 during rotation of the cylinder 6. It is the friction between the end of the cylinder and the fluid, and the fluid friction which produces the vortex. In order to achieve a sufficiently strong vortex in the space 20, the ratio between the diameter d of the cylinder 6 and the height h of the space 20, i.e. the distance between the cylinder 6 and the bottom 14 of the cavity, should preferably be between 1 and 2, $$1<d/h<2$$

and more preferably between 1.2 and 1.6.

$$1.2<d/h<1.6$$

In the example shown in FIG. 1: d=7 mm and h=5 mm, i.e., d/h=1.4

In order to obtain a uniform vortex in the space 20, the channel 2 should preferably be disposed at a distance from the bottom 14 of the cavity.

The cylinder 6 is arranged with its longitudinal axis substantially perpendicular to the channel 2. A part of the cylinder 6 is located in the channel. The cylinder 6 is arranged so that it extends partly into the passage 2 so that an opening 22 is formed between the space 20 and the channel 2. The opening 22 allows the vortex generated in the space 20 to continue into the channel 2.

The cylinder 6 should preferably be arranged so that the distance a between the cylinder and the bottom of the channel, i.e. the size of the opening 22, is between 0.5 and 1 mm for the vortex to be able to enter the channel 2 and the fluid to be fed from the channel into the space 20.

$$0.5\text{ mm} < a < 1\text{ mm}$$

It is important that a part of the cylinder 6 extends into the channel 2 so that it can speed up the flow in the channel. Due to the friction between the envelope surface of the cylinder and the fluid, and the inner friction of the fluid, a flow radially out from the cylinder is created. It is also important that the cylinder does not extend past the entire channel, which means that no opening is formed between the space 20 and the channel 2. The device according to the invention is capable of pumping flows in the order of 100 ml/s down to a few μl/s.

Figure 6:
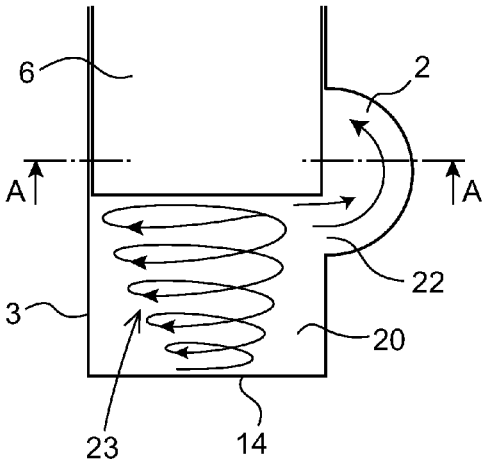
FIG. 6 shows schematically how the flow appears in a space below the pump body during use of the device.
Figure 7:
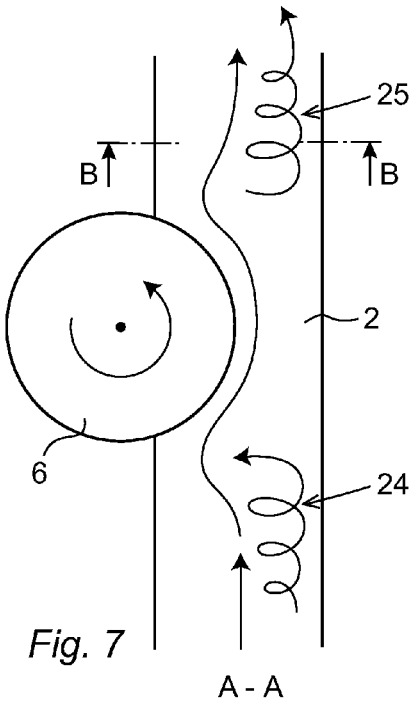
FIG. 7 shows schematically the flow in the channel in a section A-A of the device shown in FIG. 6.
Figure 8:
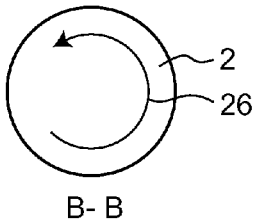
FIG. 8 shows the flow in a cross section B-B through the channel shown in FIG. 7.

FIG. 6 shows schematically the flow in the space 20 below the cylinder 6 when using the device. FIG. 7 shows schematically the flow in the channel in a section A-A of the device shown in FIG. 6. FIG. 8 shows the flow in a cross section B-B through the channel 2 in FIG. 7. When the cylinder 6 is rotated about its longitudinal axis, a vortex 23 is generated in the space 20 due to the friction between the end face of the cylinder and the fluid in the space, and the viscosity of the fluid. The rotation of the cylinder also causes centripetal forces in the fluid, which will throw the fluid in a radial direction. These forces pull the vortex 23 from the space 20 through the opening 22 into the channel 2. The vortex 23 is supplied with fluid from the channel through the opening 22.

Figure 9:
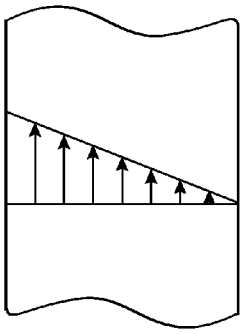
FIG. 9 shows the flow profile in the channel with a pump according to the prior art.

Due to the friction between the envelope surface of the cylinder and the fluid, shear forces acting on the fluid in the channel, which is in contact with the envelope surface of the cylinder, will arise as a result of the rotation of the cylinder, thereby creating a flow in the channel. If the vortex from the space is not guided into the channel, the flow profile in a cross section through the channel will be as shown in FIG. 9, i.e. high flow speed in the part of the channel nearest to the cylinder, and decreasing flow speed in the direction of the opposite channel wall. In addition, there is a stationary flow vortex upstream of the pump and a stationary flow vortex downstream of the pump. These stationary flow vortices disturb the flow and imply a risk for particles accumulating in unwanted places.

Due to the fact that the vortex 23, which is generated in the space below the cylinder, constantly is fed with fluid from the channel, a flow vortex 24 formed upstream of the pump is continuously sucked into the pump and thus prevented from forming a stationary flow vortex. Similarly, a flow vortex 25, which is formed downstream of the pump is prevented from forming a stationary flow vortex due to the fact that the flow of fluid out from the vortex 23 carries away the flow vortex 25. Thus, the flow to and from the vortex 23 is used to eliminating the risk of forming stationary flow vortices in the channel before and after the pump. When the vortex 23 enters into the channel, the circular walls of the channel guide the vortex so that a vortex 26 is formed along the channel walls, as shown in FIG. 8. The vortex 26 causes an increase in the flow speed in the central part of the channel and ensures that any sedimented material is moved into the flowing portion of the cross section so that there is a mixture of fluid in the channel. This achieves a more uniform flow profile across the flow direction in the channel, which leads to that a sample added to the fluid will retain its volume and is not likely to stretch.

Figure 10:
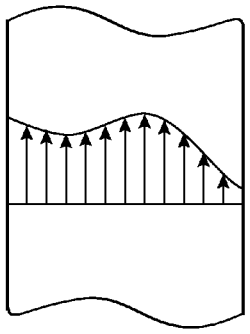
FIG. 10 shows an example of the flow profile in the channel with a device according to the invention.

FIG. 10 shows an example of a flow profile in the channel with a device according to the invention. The flow speed in the center of the channel has increased significantly compared to the prior art device, as shown in FIG. 9, and a more uniform flow profile is achieved in the channel.

The present invention is not limited to the embodiments shown, but can be varied and modified within the scope of the appended claims. For example, the upper part of the pump body and the drive unit may be designed in other ways.

The invention claimed is:

1. A device for pumping a fluid at low flows, comprising:

a body including a channel having a circular cross section for transportation of a fluid and a cylindrical cavity arranged adjacent to the channel, and a pump including a rotatable cylinder extending into the cavity and arranged so that a part of the cylinder is located in the channel wherein the channel and the cylinder are arranged at a distance from a bottom of the cavity, to form a cylindrical space between the cylinder and the bottom of the cavity for receiving a fluid, the cylinder and the cavity are arranged so that a vortex is generated in the fluid in said space by the rotation of the cylinder, and the cylinder extends partially into the channel so that an opening is formed between said space and the channel, which allows the vortex generated in the space to continue into the channel.

2. The device according to claim 1, wherein the cylinder and the cavity are arranged so that the ratio of the diameter of the cylinder and the height of said space is between 1 and 2.

3. The device according to claim 1, wherein the cylinder and the cavity are arranged so that the ratio of the diameter of the cylinder and the height of said space is between 1.2 and 1.6.

4. The device according to claim 1, wherein the cylinder (6) is arranged so that the distance between the cylinder and the bottom of the channel at said opening is between 0.5 and 1 mm.

5. The device according to claim 1, additionally comprising a drive unit (9, 10, 11) arranged to rotate said cylinder at least one revolution per second, preferably at least 2 revolutions per second.

6. The device according to claim 1, wherein the surface of the cylinder is smooth.

7. The device according to claim 1, wherein the pump comprises a drive wheel and a drive shaft fixedly mounted between the drive wheel and the cylinder, and the drive wheel has a larger diameter than the cylinder.

8. The device according to claim 1, wherein the device is arranged to pump the fluid at flows less than 100 ml/s.

* * * * *